US008077899B2

(12) United States Patent
Lan et al.

(10) Patent No.: US 8,077,899 B2
(45) Date of Patent: Dec. 13, 2011

(54) ELECTRONIC DEVICE AND PROCESS FOR MOUNTING MICROPHONE THEREIN

(75) Inventors: Yu-Hsi Lan, Hsinchu County (TW); Shien-Neng Lai, Taipei County (TW)

(73) Assignee: Fortemedia, Inc., Sunnyvale, CA (US)

( * ) Notice: Subject to any disclaimer, the term of this patent is extended or adjusted under 35 U.S.C. 154(b) by 1363 days.

(21) Appl. No.: 11/615,040

(22) Filed: Dec. 22, 2006

(65) Prior Publication Data

US 2008/0075312 A1 Mar. 27, 2008

(30) Foreign Application Priority Data

Sep. 4, 2006 (TW) ..... 95132574 A

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |

(52) U.S. Cl. ..... 381/355; 381/356; 381/357

(58) Field of Classification Search ..... 381/355, 381/356, 357, 361, 368, 369, 312, 313
See application file for complete search history.

(56) References Cited

U.S. PATENT DOCUMENTS 5,703,957 A * 12/1997 McAteer ..... 381/92

* cited by examiner

*Primary Examiner* — Tuan Nguyen
(74) *Attorney, Agent, or Firm* — Thomas|Kayden

(57) ABSTRACT

An electronic device includes a housing, a uni-directional microphone, and a cover. The housing has a first acoustic opening and a second acoustic opening. The uni-directional microphone is disposed in the housing to receive external sound via the first acoustic opening and the second acoustic opening. The cover is disposed in the housing to cover the first acoustic opening, the second acoustic opening, and the uni-directional microphone. A process for mounting a microphone includes providing a first acoustic opening and a second acoustic opening on a housing, fixing a uni-directional microphone in the housing beside the first acoustic opening, and covering the first acoustic opening, the second acoustic opening, and the uni-directional microphone with a cover.

18 Claims, 6 Drawing Sheets

ELECTRONIC DEVICE AND PROCESS FOR MOUNTING MICROPHONE THEREIN

BACKGROUND OF THE INVENTION

1. Field of the Invention

The invention relates to an electronic device and a process for mounting a microphone therein.

2. Description of the Related Art

A unidirectional microphone is capable of clearly receiving sound from a predetermined direction and avoiding environmental noise, and thus is often applicable to high-quality audio recorders or communications devices.

Referring to FIG. 1, a conventional uni-directional microphone 10 comprises round acoustic openings 13 at the front and lengthwise acoustic openings 15 on the sides. During operation, the uni-directional microphone 10 receives sound via all the acoustic openings 13 and 15. The received sound signal is then processed, wherein the sound from a predetermined direction (generally the front of the microphone 10) is positively recognized and the sound from other directions is suppressed.

If a microphone, such as unidirectional microphone 10, is mounted in an electronic device, the lengthwise acoustic openings 15 on the sides are disposed therein and reception of external sound is hindered. It is therefore understood that a conventional uni-directional microphone must always be externally connected to an electronic device.

BRIEF SUMMARY OF THE INVENTION

The invention provides a unidirectional microphone in an electronic device capable of clearly receiving external sound, regardless of the shape of the housing of the electronic device.

The electronic device comprises a housing, a unidirectional microphone, and a cover. The housing comprises a first acoustic opening and a second acoustic opening. The uni-directional microphone is disposed in the housing to receive external sound via the first acoustic opening and the second acoustic opening. The cover is disposed in the housing to cover the first acoustic opening, the second acoustic opening, and the uni-directional microphone.

The uni-directional microphone may contact an inner surface of the housing.

The electronic device may further comprise a sound absorbing material attached to an inner surface of the cover.

The cover may be made of sound absorbing material.

The electronic device may further comprise an air permeable material disposed in the first acoustic opening.

The electronic device may further comprise an air permeable material disposed in the second acoustic opening.

The electronic device may further comprise an omni-directional microphone disposed in the housing. The housing may be further provided with a third acoustic opening and the omni-directional microphone receives the external sound via the third acoustic opening.

The cover also covers the third acoustic opening and the omni-directional microphone.

The electronic device may further comprise a partition disposed between the uni-directional microphone and the omni-directional microphone.

The partition and the cover constitute a continuous-unitary structure. Alternatively, the partition and the housing constitute a continuous-unitary structure.

The omni-directional microphone may contact an inner surface of the housing.

The invention further provides a process for mounting a microphone. The process comprises: providing a first acoustic opening and a second acoustic opening on a housing; fixing a uni-directional microphone in the housing beside the first acoustic opening; covering the first acoustic opening, the second acoustic opening, and the uni-directional microphone with a cover.

The process may further comprise attaching a sound absorbing material to an inner surface of the cover.

The process may further comprise locating an air permeable material in the first acoustic opening.

The process may further comprise locating an air permeable material in the second acoustic opening.

The invention provides another process for mounting microphones. The process comprises: providing a first acoustic opening; a second acoustic opening, and a third acoustic opening on a housing; fixing a uni-directional microphone in the housing beside the first acoustic opening; fixing an omni-directional microphone in the housing beside the third acoustic opening; locating a partition between the omni-directional microphone and the uni-directional microphone; and covering the first acoustic opening, the second acoustic opening, the third acoustic opening, the omni-directional microphone, and the unidirectional microphone with a cover.

The process may further comprise attaching a sound absorbing material to an inner surface of the cover.

The process may further comprise locating an air permeable material in the first acoustic opening.

The process may further comprise locating an air permeable material in the second acoustic opening.

The process may further comprise locating an air permeable material in the third acoustic opening.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
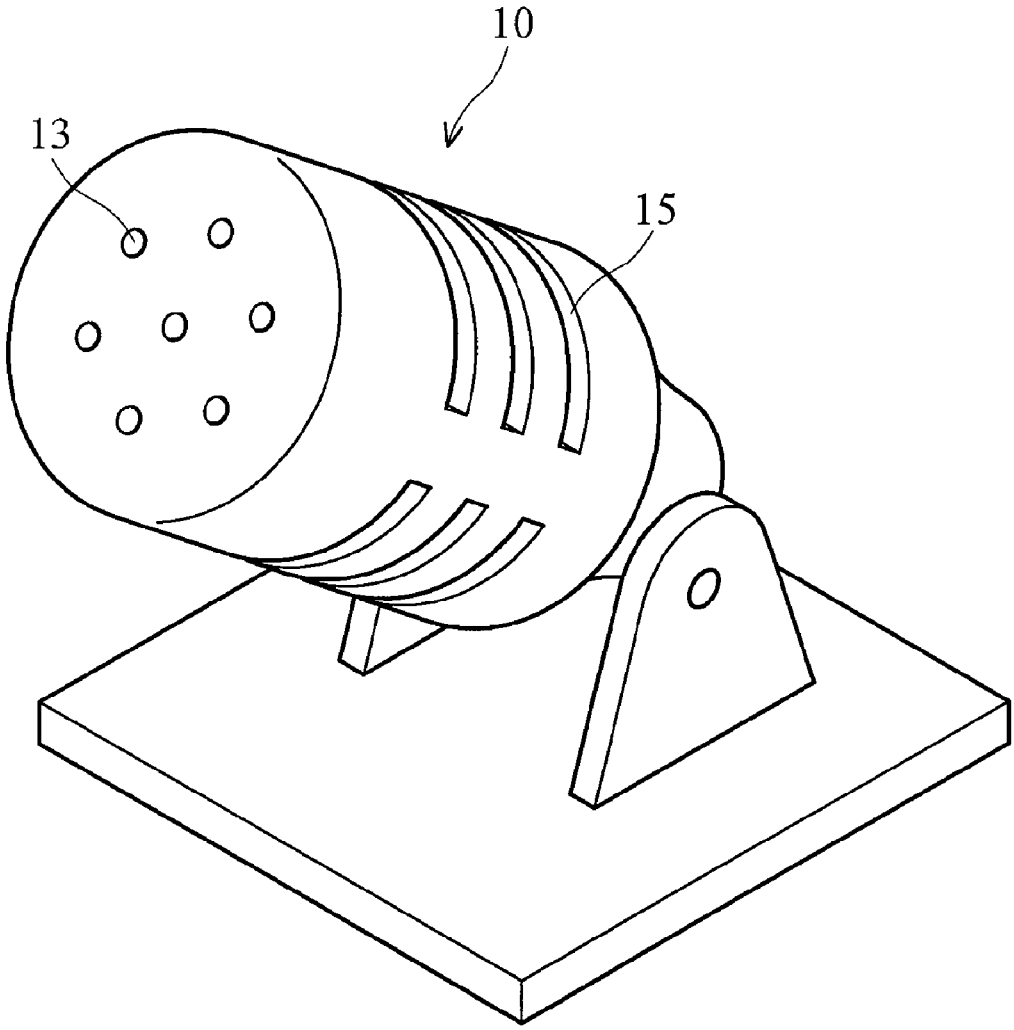
FIG. 1 (PRIOR ART)
FIG. 1 depicts a conventional uni-directional microphone.
Figure 2A:
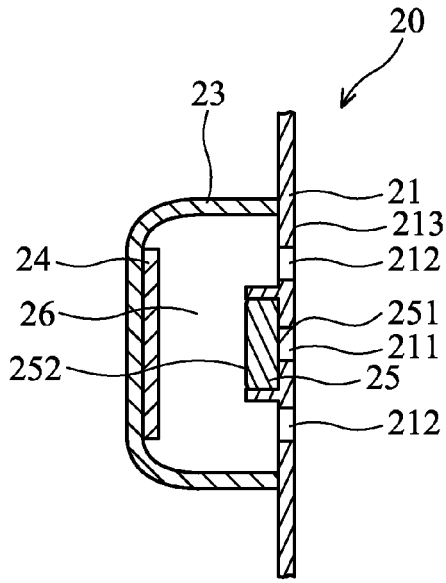
FIG. 2A is a local sectional view of an electronic device in accordance with a first embodiment of the invention.

FIG. 2A is a local sectional view of an electronic device in accordance with a first embodiment of the invention, wherein a uni-directional microphone 25 is mounted in, rather than externally connected to, the electronic device 20.

The electronic device 20 comprises a housing 21 comprising a first acoustic opening 211, a plurality of second acoustic openings 212, and an outer surface 213. The first acoustic opening 211 is disposed on the outer surface 213. The uni-directional microphone 25 is located beside the first acoustic opening 211 and contacts the inner surface of the housing 21. The uni-directional microphone 25 includes a first surface 251 and a second surface 252 opposite to the first surface 251. The first surface 251 is substantially parallel to the outer surface 213, and the first surface 251 faces the first acoustic opening 211. A cover 23 is connected to the housing 21 and covers the first acoustic opening 211, the second acoustic openings 212, and the uni-directional microphone 25, wherein a space 26 is formed between the cover 23 and the housing 21, and the uni-directional microphone 25 is located between the space 26 and the first acoustic opening 211. The second surface 252 faces the space 26. Thus, the uni-directional microphone 25 receives external sound via the first acoustic second acoustic opening 211. The external sound also propagates through the second acoustic openings 212 into the space 26 and is received by the uni-directional microphone 25.

Note that the first and second acoustic openings 211 and 212 are provided on the housing 21 to allow the unidirectional microphone 25 to receive external sound. Thus, the arrangement of the uni-directional microphone 25 in the electronic device 20 does not influence the quality of the received sound. The uni-directional microphone 25 processes the received sound signal wherein the sound from a predetermined direction is positively recognized and the sound from other directions is suppressed.

A sound absorbing material 24 is attached to the inner surface of the cover 23 for suppressing sound wave reflection and preventing resonance in the space 26.

Figure 2B:
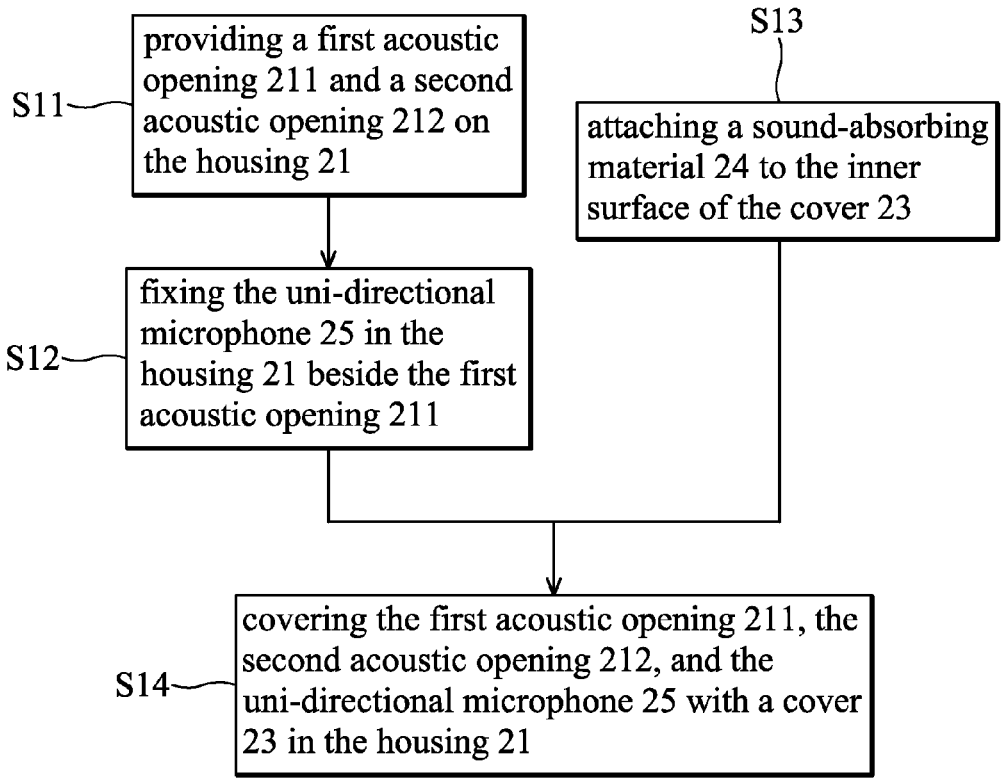
FIG. 2B is a flowchart of mounting the uni-directional microphone of FIG. 2A.

FIG. 2B is a flowchart of mounting the uni-directional microphone of FIG. 2A. In step S11, a first acoustic opening 211 and a second acoustic opening 212 are provided on the housing 21. In step S12, the unidirectional microphone 25 is fixed in the housing 21 and located beside the first acoustic opening 211. In step S13, a sound absorbing material 24 is attached to the inner surface of the cover 23. In step S14, the first acoustic opening 211, the second acoustic opening 212, and the uni-directional microphone 25 are covered by a cover 23 in the housing 21.

Figure 3:
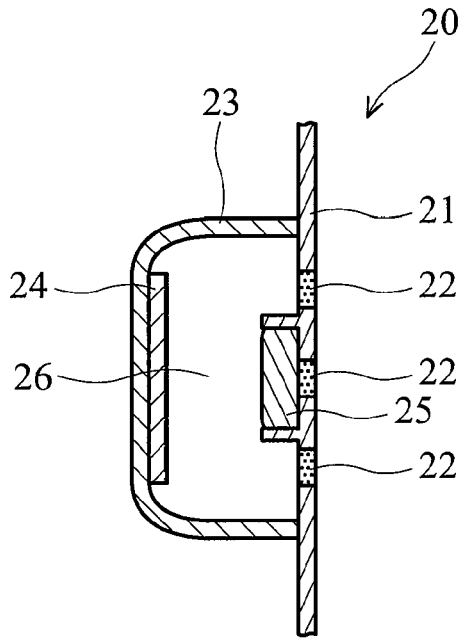
FIG. 3 is a local sectional view of an electronic device in accordance with a second embodiment of the invention.

FIG. 3 is a local sectional view of an electronic device in accordance with a second embodiment of the invention, wherein the same references will be used for elements which are identical or similar to those shown in FIG. 2A. In the second embodiment, air permeable material 22 blocks the first and second acoustic openings. The air permeable material 22 allows passage of sound but keeps dust outside.

Figure 4:
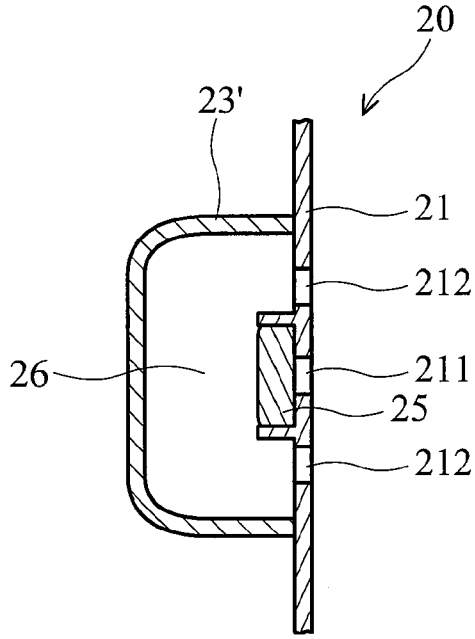
FIG. 4 is a local sectional view of an electronic device in accordance with a third embodiment of the invention.

FIG. 4 is a local sectional view of an electronic device in accordance with a third embodiment of the invention, wherein the same references are used for elements which are identical or similar to those shown in FIG. 2A. In the third embodiment, the cover 23' is made of sound absorbing material for suppressing sound wave reflection and preventing resonance in space 26.

Figure 5A:
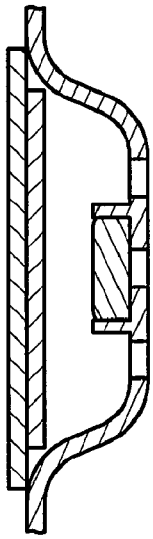
FIGS. 5A and 5B depict a uni-directional microphone of the invention mounted in electronic devices of different shapes.
Figure 5B:
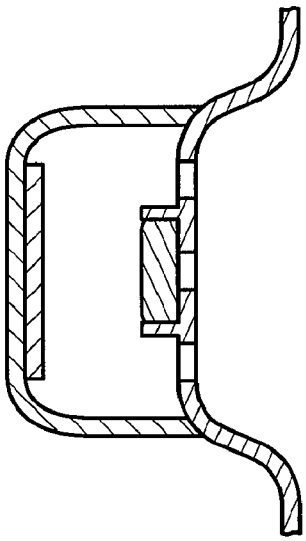

The invention allows an electronic device to contain a uni-directional microphone regardless of the shape of the housing of the electronic device. In FIGS. 2A, 3, 4, for example, a uni-directional microphone is mounted in an electronic device comprising a flat housing. In FIG. 5A, the housing is convex. In FIG. 5B, the housing is concave.

Figure 6A:
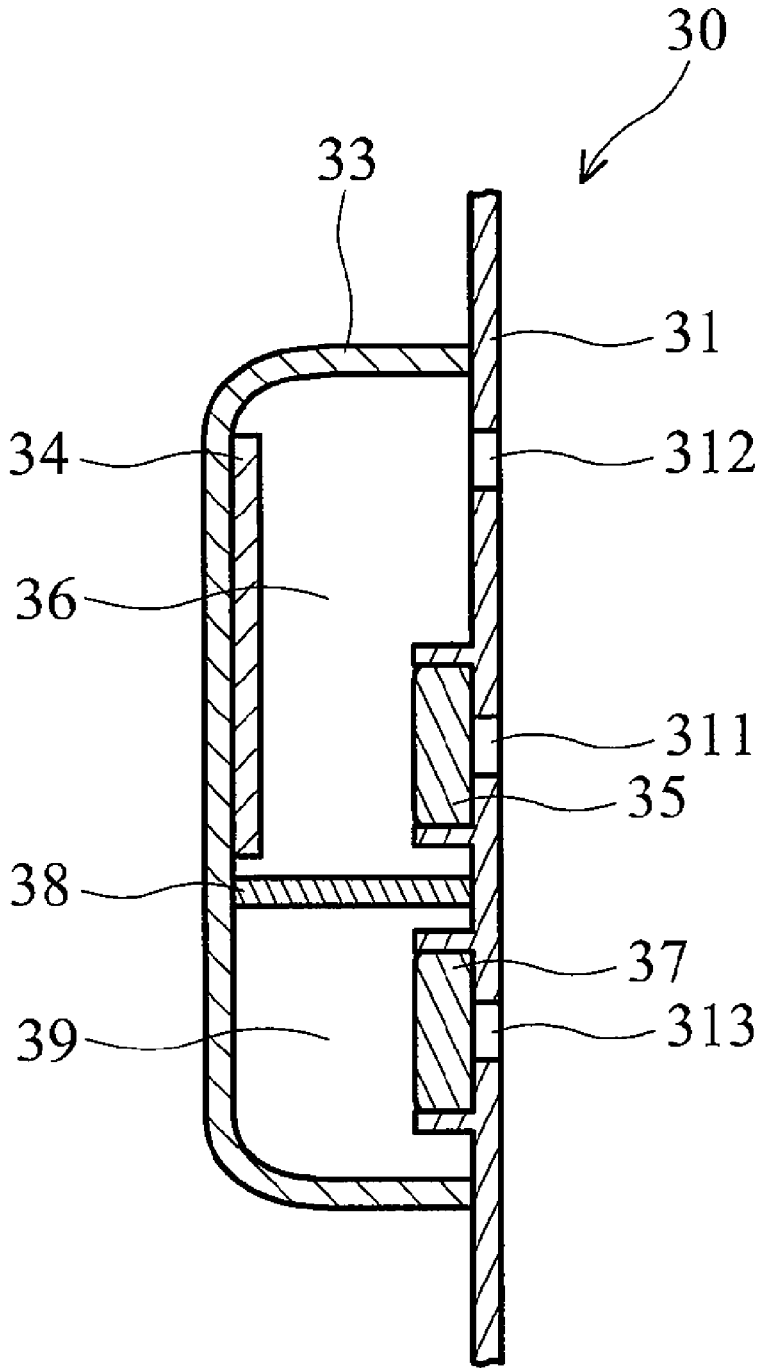
FIG. 6A is a local sectional view of an electronic device in accordance with a fourth embodiment of the invention.

FIG. 6A is a local sectional view of an electronic device in accordance with a fourth embodiment of the invention, wherein a microphone array is mounted in an electronic device 30. The microphone array comprises a unidirectional microphone 35 and an omni-directional microphone 37. The electronic device 30 comprises a housing 31 which is provided with a first acoustic opening 311, a second acoustic opening 312, and a third acoustic opening 313. The uni-directional microphone 35 is located beside the first acoustic opening 311 and contacts the inner surface of the housing 31 to receive external sound via the first acoustic opening 311 and the second acoustic opening 312. The omni-directional microphone 37 is located beside the third acoustic opening 313 and contacts the inner surface of the housing 31 to receive external sound via the third acoustic opening 313. Furthermore, a cover 33 is connected to the housing 31 and covers the first acoustic opening 311, the second acoustic opening 312, the third acoustic opening 313, the omni-directional microphone 37, and the uni-directional microphone 35. A partition 38 divides the interior of the cover 33 into two spaces 36 and 39. The uni-directional microphone 35 and the omni-directional microphone 37 are respectively disposed in the spaces 36 and 39. The partition 38 comprises sound insulation material preventing transmission of sound between the two spaces 36 and 39. Furthermore, a sound absorbing material 34 is attached to the inner surface of the cover 33 for suppressing sound wave reflection and preventing resonance in space 36.

The partition 38 may be integrally formed with the cover 33 or the housing 31 as a continuous-unitary structure, or be an element different from the cover 33 and the housing 31.

Figure 6B:
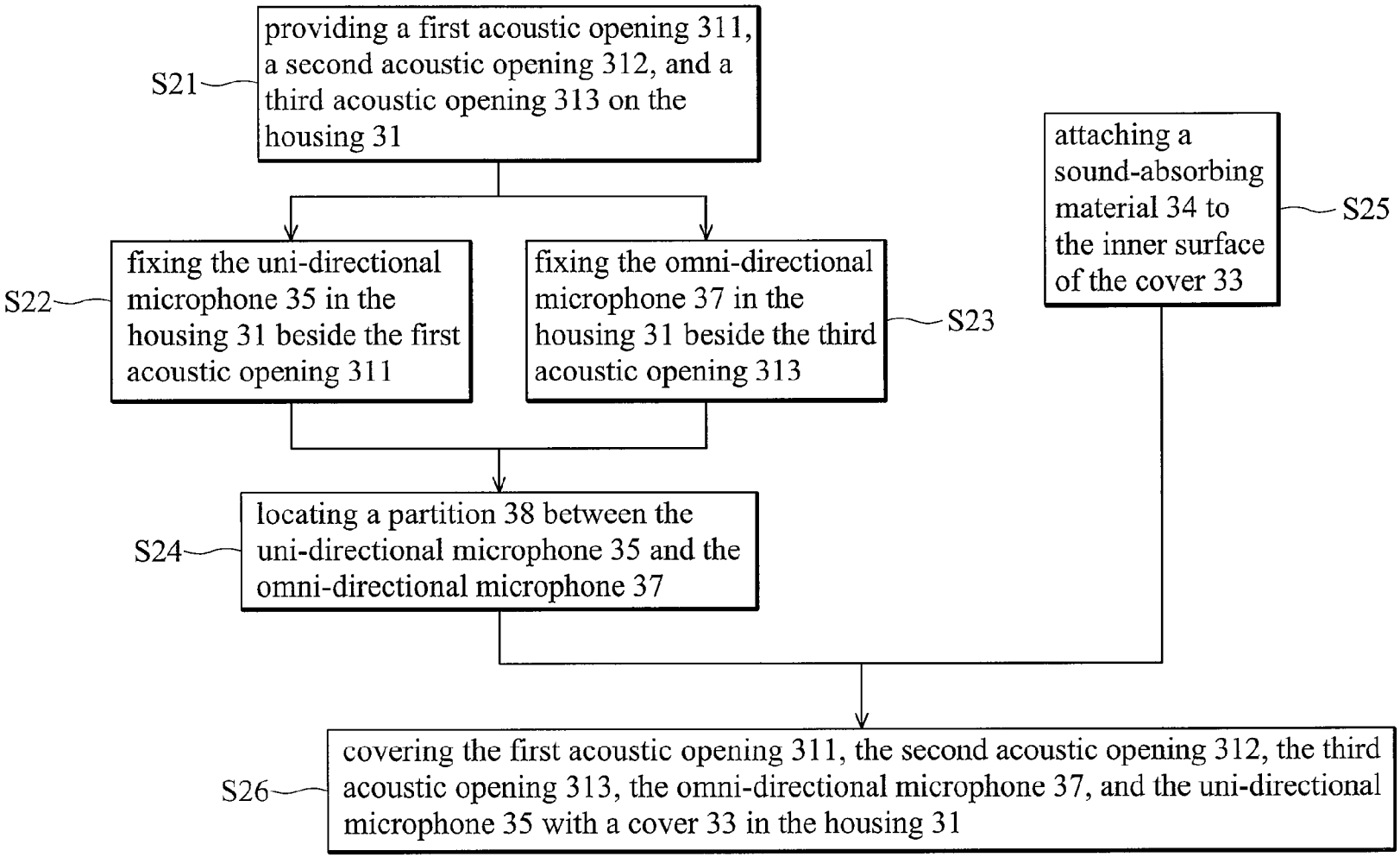
FIG. 6B is a flowchart of mounting the microphone array of FIG. 6A.

FIG. 6B is a flowchart of a process for mounting the microphone array of FIG. 6A. In step S21, a first acoustic opening 311, a second acoustic opening 312, and a third acoustic opening 313 are provided on the housing 31. In step S22, the uni-directional microphone 35 is fixed in the housing 31 and located beside the first acoustic opening 311. In step S23, the omni-directional microphone 37 is fixed in the housing 31 and located beside the third acoustic opening 313. In step S24, a partition 38 is disposed between the uni-directional microphone 35 and the omni-directional microphone 37. In step S25, a sound absorbing material 34 is attached to the inner surface of the cover 33. In step S26, the first acoustic opening 311, the second acoustic opening 312, the third acoustic opening 313, the omni-directional microphone 37, and the uni-directional microphone 35 are covered by the cover 33 in the housing 31.

Similarly, in a modified embodiment, air permeable material may be provided to block the first, second, and third acoustic openings allowing passage of sound while keeping dust outside. Furthermore, the cover 33 may comprise sound absorbing material for suppressing sound wave reflection and preventing resonance in space 36.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a housing comprising an outer surface, a first acoustic opening and a second acoustic opening, wherein the first acoustic opening is disposed on the outer surface;

a uni-directional microphone disposed in the housing for receiving external sound via the first acoustic opening and the second acoustic opening; and a cover disposed in the housing covering the first acoustic opening, the second acoustic opening, and the uni-directional microphone, wherein the uni-directional microphone comprises a first surface substantially parallel to the outer surface, and the first surface faces the first acoustic opening.

2. The electronic device as claimed in claim 1, wherein the uni-directional microphone contacts an inner surface of the housing.

3. The electronic device as claimed in claim 1, further comprising a sound absorbing material attached to an inner surface of the cover.

4. The electronic device as claimed in claim 1, wherein the cover is made of sound absorbing material.

5. The electronic device as claimed in claim 1, further comprising an air permeable material disposed in the first acoustic opening.

6. The electronic device as claimed in claim 1, further comprising an air permeable material disposed in the second acoustic opening.

7. The electronic device as claimed in claim 1, further comprising an omni-directional microphone disposed in the housing, wherein the housing further comprises a third acoustic opening and the omni-directional microphone receives the external sound via the third acoustic opening.

8. The electronic device as claimed in claim 7, wherein the cover also covers the third acoustic opening and the omni-directional microphone.

9. The electronic device as claimed in claim 8, further comprising a partition disposed between the uni-directional microphone and the omni-directional microphone.

10. The electronic device as claimed in claim 9, wherein the partition and the cover constitute a continuous-unitary structure.

11. The electronic device as claimed in claim 9, wherein the partition and the housing constitute a continuous-unitary structure.

12. The electronic device as claimed in claim 7, wherein the omni-directional microphone contacts an inner surface of the housing.

13. The process as claimed in claim 1, wherein a space is formed between the cover and the housing, and the uni-directional microphone is located between the space and the first acoustic opening.

14. The process as claimed in claim 13, wherein the uni-directional microphone comprises a second surface opposite to the first surface, and the second surface faces the space.

15. A process for mounting a microphone, comprising:

providing a first acoustic opening and a second acoustic opening on an outer surface of a housing;

fixing a uni-directional microphone in the housing, with the uni-directional microphone located beside the first acoustic opening, wherein the uni-directional microphone comprises a surface substantially parallel to the outer surface, and the first surface faces the first acoustic opening; and covering the first acoustic opening, the second acoustic opening, and the uni-directional microphone with a cover.

16. The process as claimed in claim 15, further comprising attaching a sound absorbing material to an inner surface of the cover.

17. The process as claimed in claim 15, further comprising locating an air permeable material in the first acoustic opening.

18. The process as claimed in claim 15, further comprising locating an air permeable material in the second acoustic opening.

* * * * *